US005808528A

United States Patent [19]

Griffith et al.

[11] Patent Number: 5,808,528

[45] Date of Patent: Sep. 15, 1998

[54] BROAD-BAND TUNABLE WAVEGUIDE FILTER USING ETCHED SEPTUM DISCONTINUITIES

[75] Inventors: Robert K. Griffith; Craig R. Solis, both of San Jose; Cheyenne M. Noda, Campbell; William F. Melody, Morgan Hill, all of Calif.

[73] Assignee: Digital Microwave Corporation, San Jose, Calif.

[21] Appl. No.: 708,594

[22] Filed: Sep. 5, 1996

[51] Int. Cl.[6] ..... H01P 1/207

[52] U.S. Cl. ..... 333/229; 333/208; 333/235

[58] Field of Search ..... 333/208–212, 333/205, 231–233, 248, 235

[56] References Cited

U.S. PATENT DOCUMENTS

| | | | |
|---|---|---|---|
| 2,428,287 | 9/1947 | Linder | 333/233 |
| 2,829,352 | 4/1958 | Hennies et al. | 333/233 |
| 3,428,921 | 2/1969 | Hargis | 333/232 |
| 3,940,721 | 2/1976 | Kojima et al. | 333/233 |
| 4,066,988 | 1/1978 | Karp | 333/82 B |
| 4,201,956 | 5/1980 | Kienberger et al. | 331/96 |
| 4,311,975 | 1/1982 | Benoit et al. | 333/207 |
| 4,380,747 | 4/1983 | Curtinot et al. | 333/202 |
| 4,460,878 | 7/1984 | Fouillet et al. | 333/207 |
| 4,578,655 | 3/1986 | Etienne et al. | 333/202 |
| 4,746,883 | 5/1988 | Sauvage et al. | 333/202 |
| 4,754,227 | 6/1988 | Teague | 328/167 |
| 4,761,625 | 8/1988 | Sharma | 333/209 |
| 4,990,871 | 2/1991 | Reindel | 333/209 |
| 5,070,313 | 12/1991 | Gladh et al. | 333/202 |
| 5,133,028 | 7/1992 | Okayama et al. | 385/11 |

FOREIGN PATENT DOCUMENTS

| | | |
|---|---|---|
| O346 806 A1 | 12/1989 | European Pat. Off. . |
| 2 538 958 | 6/1984 | France . |
| WO 93/21666 | 10/1993 | WIPO . |

OTHER PUBLICATIONS

"Analysis of Compact E–Plane Diplexers in Rectangular Waveguide", Antonio Morini, etc., IEEE Transactions on Microwave Theory and Techniques, vol., 43, No. 8, Aug. 1995, pp. 1834–1839.

"E–Plane Filters With Finite–Thickness Septa", Yi–Chi Shih, etc., IEEE Transactions on Microwave Theory and Techniques, vol., MTT–31, No. 12, Dec. 1983, pp. 1009–1012.

"Computer–Aided Design of Millimeter–Wave E–Plane Filters", Yi–Chi Shih, etc., IEEE Transactions on Microwave Theory and Techniques, vol., MTT–31, No. 2, Feb. 1983, pp. 135–141.

"The Design of a Bandpass Filter With Inductive Strip–Planar Circuit Mounted in Waveguide", Yoshihiro Konishi, etc., IEEE Transactions on Microwave Theory and Techniques, vol., MTT–22, No. 10, Oct. 1974, pp. 869–873.

*Primary Examiner*—Seungsook Ham

*Attorney, Agent, or Firm*—Skjerven, Morrill, MacPherson, Franklin & Friel; Edward C. Kwok

[57] ABSTRACT

An inductive strip waveguide band-pass filter includes a conductive movable wall which can be set to various positions to allow a varying "A" dimension, thereby setting controllably the center frequency of the filter over a predetermined range. If the inductive strip filter includes multiple synchronized resonant cavities, the resonant cavities remain synchronized for all positions of the movable wall. The position of the movable wall can be set manually or by a motorized control mechanism.

12 Claims, 7 Drawing Sheets

TABLE 1

| GUIDE A DIMENSION | GUIDE A MILS | LAMBDA CUTOFF FREQUENCY | LAMBDA GUIDE INCHES | EFFECT OF LAMBDA GUIDE ON FILTER | PERCENT CHANGE | TOUCHSTN CALCULATE | PERCENT CHANGE | MEASURED DATA | PERCENT CHANGE |
|---|---|---|---|---|---|---|---|---|---|
| 0.365 | 365 | 16.167 | 1.193 | 23.650 | 0% | 24.230 | 0% | 23.762 | 0% |
| 0.390 | 390 | 15.131 | 1.038 | 22.660 | –4% | 23.280 | –4% | 23.175 | –3% |
| 0.415 | 415 | 14.219 | 0.937 | 21.850 | –8% | 22.480 | –8% | 22.437 | –6% |
| 0.440 | 440 | 13.411 | 0.866 | 21.100 | –12% | 21.750 | –11% | 21.550 | –10% |
| 0.465 | 465 | 12.690 | 0.815 | 20.450 | –16% | 21.050 | –15% | 20.587 | –15% |
| INCHES | MILS | GHz | INCHES | GHz | | GHz | | GHz | |

FIGURE 5A

BROAD-BAND TUNABLE WAVEGUIDE FILTER USING ETCHED SEPTUM DISCONTINUITIES

BACKGROUND OF THE INVENTION

1. Field of the Invention

The present invention relates to telecommunication. In particular, the present invention relates to waveguide filters used in telecommunication.

2. Description of the Related Art

Waveguide bandpass filters are often configured as "diplexers" to transmit and receive frequencies. These bandpass filters include "inductive strip filters". An example of an inductive strip filter can be found in "The Design of a Bandpass Filter with Inductive Strip—Planar Circuit Mounted on Waveguide," by Y. Konishi and K. Uenakada, *IEEE Transaction on Microwave Theory and Techniques,* vol. MTT-22, No. 10, October 1974, pp. 869–873. In many applications, the receiver and the transmitter frequencies are sufficiently close, so that a microwave radio manufacturer must individually design, construct and hold in inventory a large number of similar filters to satisfy the possible frequencies that can be used in a given frequency band in order to minimize delivery delays. Consequently, the microwave manufacturer incurs a high cost of inventory to meet its customers3 requirements. In addition, since these filters are individually custom-built and tested, the filters must be factory-tuned, rather than tuned in the field at the time of installation.

An inductive strip bandpass filter is formed by providing one or more etched septa spaced at approximately one-quarter wavelength in a waveguide section. The septum is a conductive metallic strip which provides series and shunt inductances across the E-plane of the waveguide. This configuration can be used to form a filter of any number of poles (typically 2 to 8 poles). Because of the closeness of the receiver and transmitter frequencies, the typical bandwidth in such a bandpass filter is between 1–3% of the filter center frequency. Other examples of waveguide bandpass filters can be found in (i) "Computer-Aided Design of Millimeter-Wave E-Plane Filters", by Yi-Chi Shih, *IEEE Transactions on Microwave Theory,* Vol. MTT-31, No. 2, February 1983, pp. 135–142; (ii) "E-Plane Filters with Finite-Thickness Septa," by Yi-Chi Shih and Tatsuo Itoh, Vol. MTT-31, No. 12, December 1983, pp. 1009–1013; and (iii) "Analysis of Compact E-Plane Diplexers in Rectangular Waveguide," by Antonio Morini, *IEEE Transaction on Microwave Theory,* Vol. 43, No.8, August 1995, pp. 1834–1839.

SUMMARY OF THE INVENTION

The present invention provides a waveguide bandpass filter, which includes (a) a conductive waveguide having conductive walls and a movable conductive wall defining the broad dimension ("A dimension") of the waveguide; (b) a mechanism for maintaining ohmic contact between the conductive walls of the waveguide and the movable conductive wall; and (c) an etched septum conductive strip included in the waveguide to define one or more resonator cavities in the waveguide.

In accordance with one method of the present invention, an inductive strip waveguide bandpass filter having a center frequency within a few percentage points of the desired frequency is tuned to the desire frequency by adjusting the movable wall of the waveguide.

The tunable bandpass filter of the present invention can be tuned, manually or by a motorized control mechanism, with a single adjustment provided by a single lead screw, an offset wheel or an offset cam. The motor-driven lead screw, for example, can be driven by a servo-motor or a stepper-motor through a rack-and-pinion mechanism. Such motors can be controlled by software.

The present invention is better understood upon consideration of the detailed description below and the accompanying drawings.

BRIEF DESCRIPTION THE DRAWINGS

FIG. 1 shows a artial cut-away view of an inductive strip waveguide bandpass filter 100, in accordance with the present invention.

FIGS. 2*a* and 2*b* show, in inductive strip waveguide bandpass filter 100, two ways for providing ohmic contact between movable wall 102 and waveguide 101.

FIG. 5*a* shows Table 1, which tabulates the calculated cut-off wavelengths ($\lambda_c$), the characteristic waveguide wavelengths ($\lambda_g$), and the calculated and measured resonator frequencies ($f_r$), for various A dimension values of filter 100.

Figure 5B:
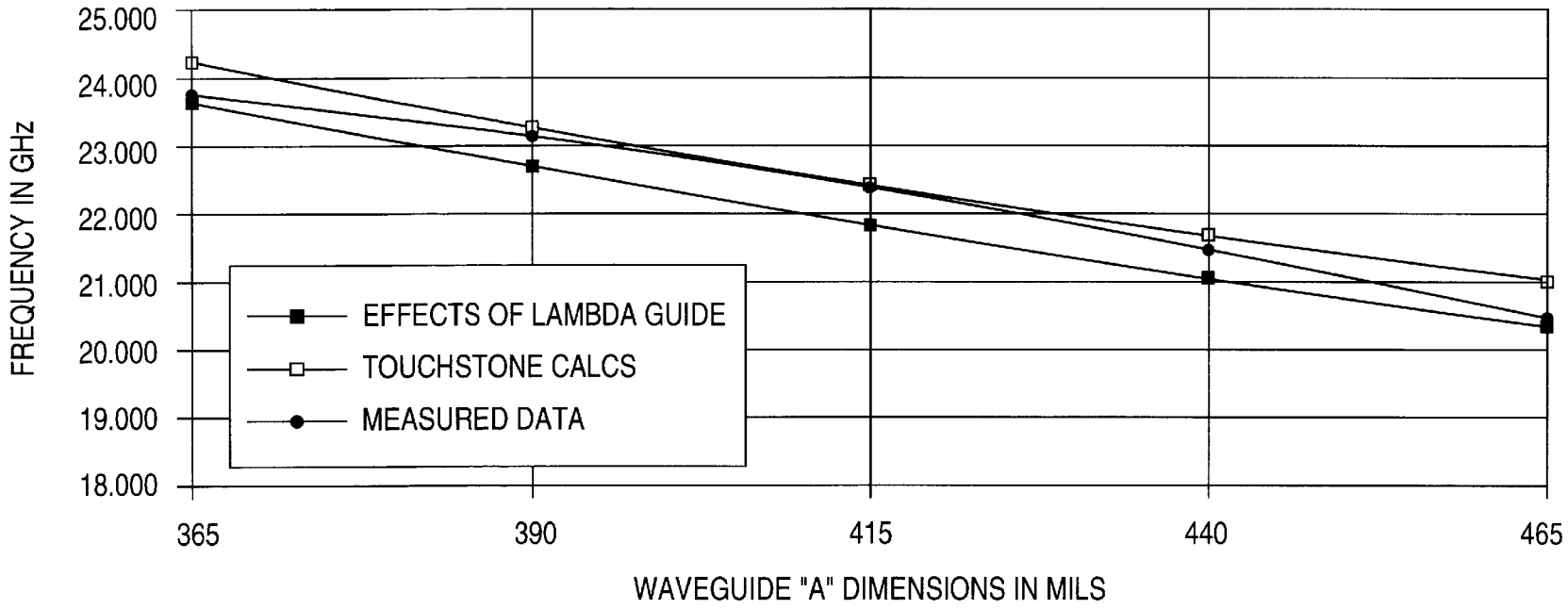

FIG. 5*b* shows the characteristic waveguide wavelengths ($\lambda_g$), and the calculated and measured resonator frequencies ($f_r$), for the same various A dimension values of filter 100 shown in Table 1 of FIG. 5*a*.

Figure 6:
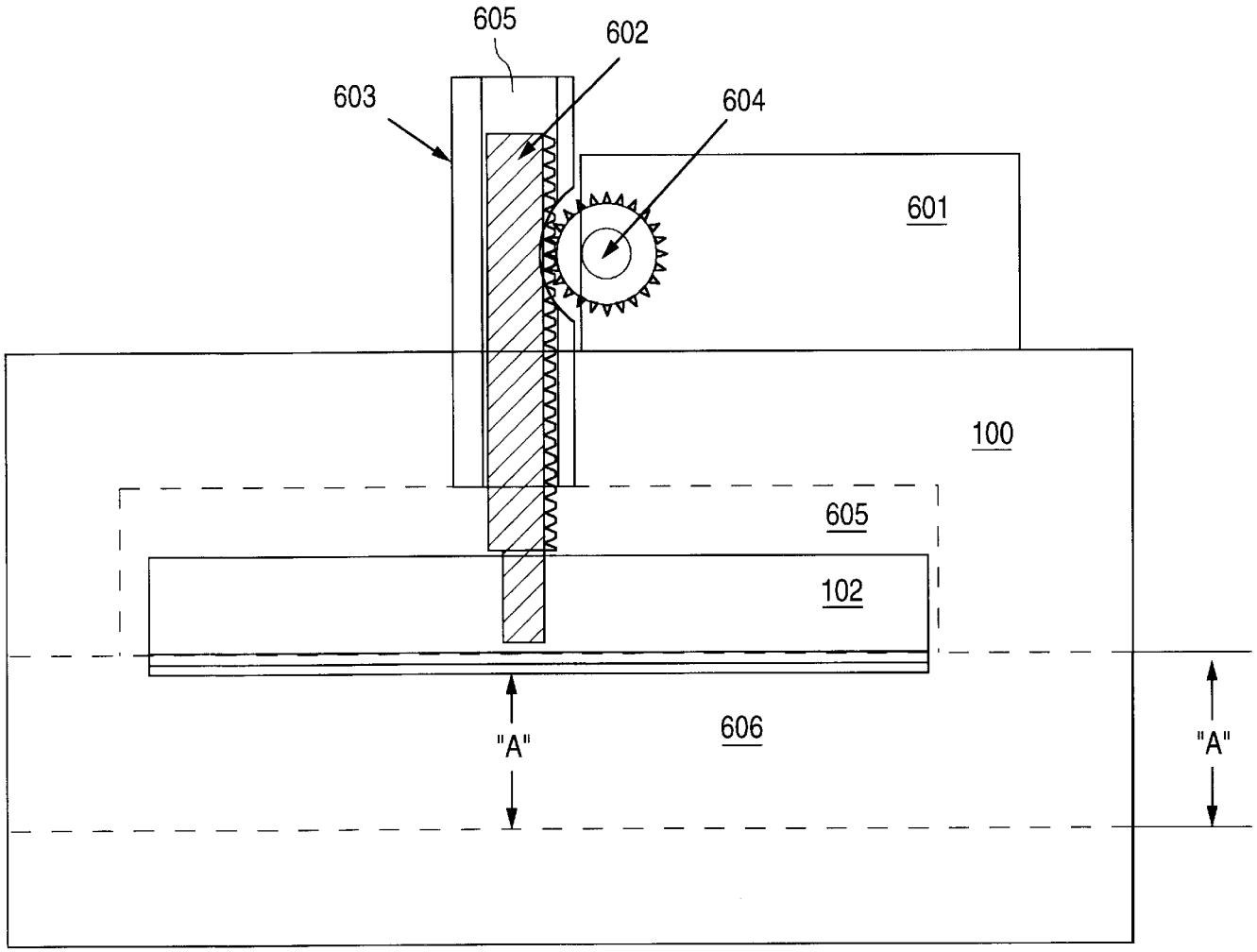

FIG. 6 shows an embodiment 600 of the present invention, showing movable wall 102 of waveguide bandpass filter 100 driven by a servo-motor 601 through a rack-and-pinion mechanism.

DETAILED DESCRIPTION OF THE PREFERRED EMBODIMENTS

The present invention provides a multi-pole tunable bandpass filter that can be mechanically tuned with a single adjustment.

Figure 1:
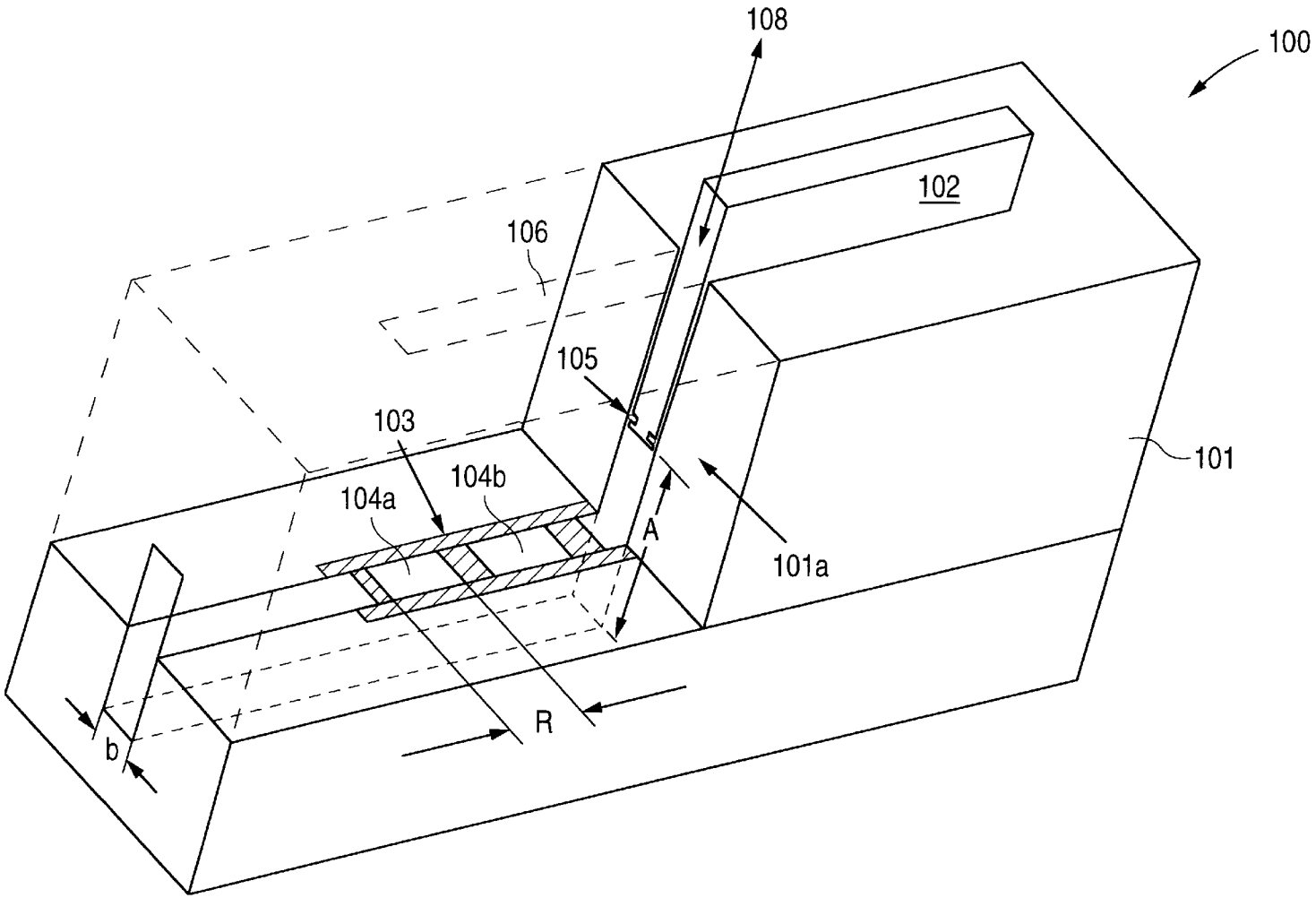

FIG. 1 shows a partial cut-away view of an inductive strip waveguide bandpass filter 100, in accordance with the present invention. As shown in FIG. 1, inductive strip waveguide bandpass filter 100 includes a rectangular waveguide 101 with a movable wall 102. Movable wall 102 is designed to slide up and down slot 106, i.e. along the directions indicated by arrow 108, so as to allow the broad dimension ("'A' dimension") of the waveguide to be varied. Portion 101*a* of waveguide 101 is cut away to show metallic inductive strip 103, which defines resonators 104*a* and 104*b*. Waveguide 101 and movable wall 102 can each be formed out of aluminum or any conductive material. Inductive strip 103 is typically formed out of Beryllium Copper (BeCu), which is a readily etchable material. Waveguide 101 can be formed by two U-shaped aluminum blocks, so that inductive strip 103 can be provided as an insert between the two U-shaped aluminum blocks.

In this embodiment, to ensure proper electrical connectivity, a conductive gasket 105 (or, alternatively, a copper chute) is provided in two recessed groves running along the lengths of movable wall 102. As movable wall 102 slides down slot 106, the center frequency of inductive strip waveguide bandpass filter 100 is found to vary in a predictable fashion, while still maintaining reasonable filter performance. If the inductive strip defines several synchronized resonators, these resonators remain synchronized, i.e. resonating at exactly the same frequency, for all values of the A dimension.

In a rectangular waveguide, such as waveguide 101, the broad dimension (i.e. the "A" dimension) determines the passband frequencies, and the narrow dimension ("'b' dimension") determines the impedance of the waveguide. The wavelength $\lambda_0$ of an electromagnetic wave propagating in air or vacuum, expressed in inches, is given by:

$$\lambda_0 = \frac{11.801}{f}$$

where f is the frequency of the electromagnetic wave in GHz. In a waveguide, the wavelength $\lambda_c$, in inches, for the cut-off frequency $f_c$ for a mode m is given by:

$$\lambda_c = \frac{2a}{m}$$

where a is the A dimension in inches. For the dominant waveguide mode, m is 1. The wavelength $\lambda_g$, in inches, for the characteristic waveguide frequency $f_g$ is given by:

$$\lambda_g = \frac{\lambda_0}{1 - \left(\frac{\lambda_0}{\lambda_c}\right)^2}$$

Using the above-discussed relations of $\lambda_0$ and $\lambda_g$, the resonator frequency $f_r$ for a given resonator dimension ("R dimension", e.g. the longest dimension R of each of resonators 104*a* and 104*b*) in an inductive strip waveguide filter can be obtained as a function of the A and R dimensions by solving the equation:

$$R = \frac{\lambda_g}{4}$$

Figure 4:
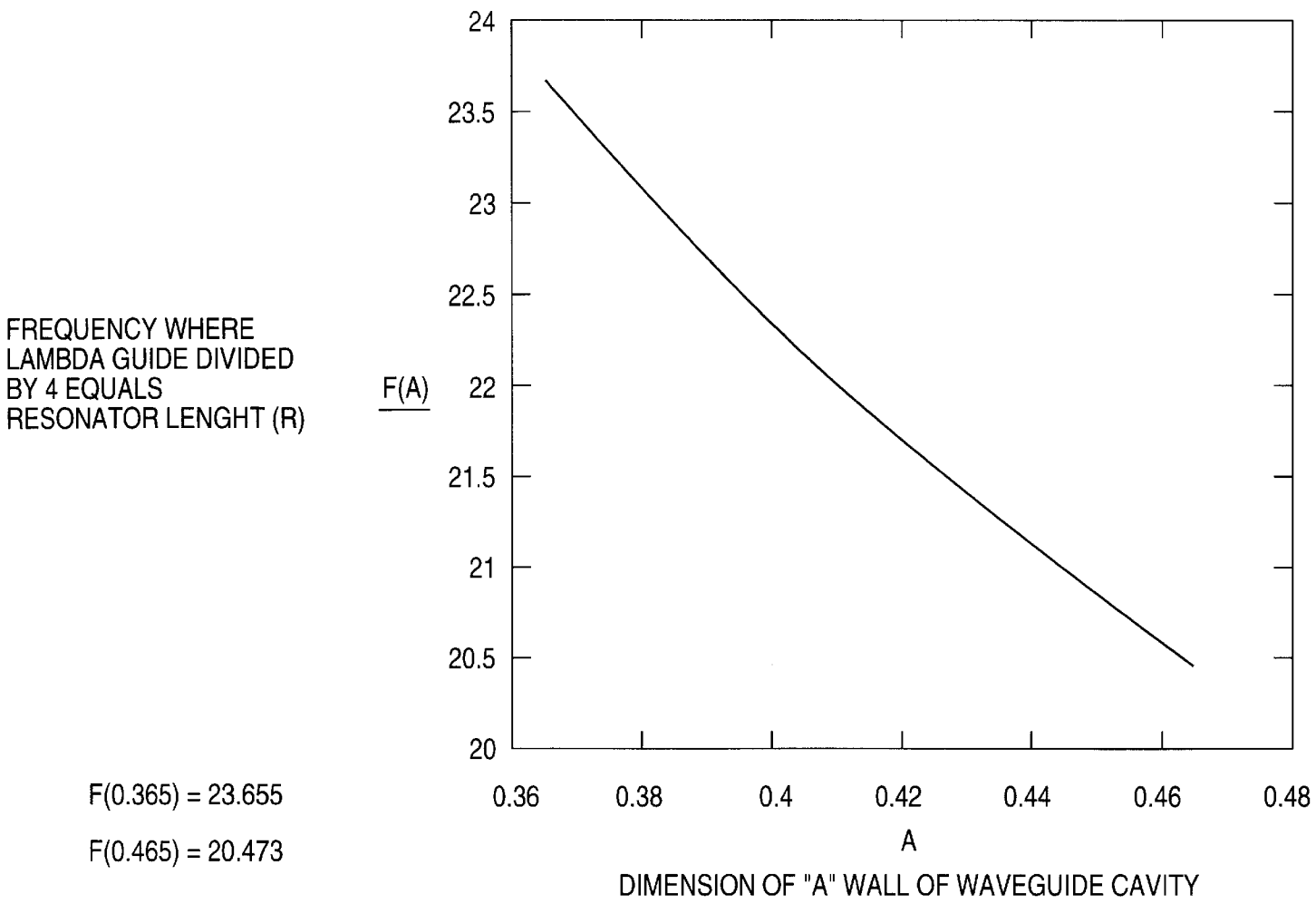
FIG. 4 is a plot of frequency $f_r$ versus the A dimension, using an R dimension of 0.234 inches.

FIG. 4 is a plot of resonator frequency $f_r$ versus the A dimension, using 0.234 inches as the value for the R dimension.

Figure 2A:
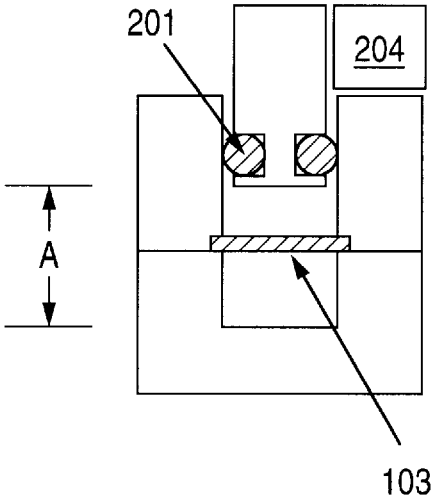
Figure 2B:
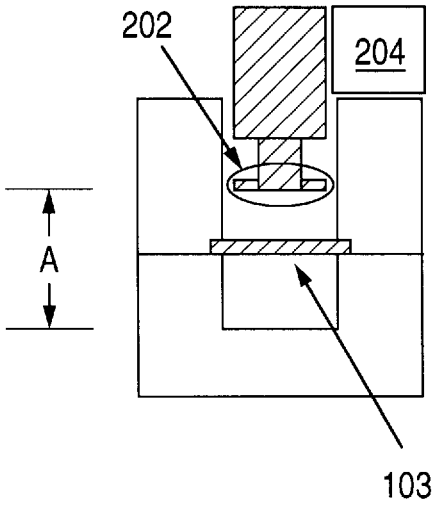

FIGS. 2*a* and 2*b* show, in inductive strip waveguide bandpass filter 100, two ways for providing ohmic contact between movable wall 102 and waveguide 101. In FIG. 2*a,* an elastomer conductive gasket 201 is fitted into two grooves running along the lengths of waveguide 101. In FIG. 2*b,* a copper trough or chute 202 provides a spring action to hold movable wall 102 snugly against the side walls of waveguide 101 to ensure a good ohmic contact. The movement of movable wall 102 relative to the walls of waveguide 101 can be provided either manually or automatically using a motor. To ensure accurate tuning, and to maintain filter characteristics, movable wall 102 should be kept flat or level. Precise control of the displacement of movable wall 102 relative to the side walls of waveguide 101 can be achieved by a lead screw (not shown). This lead screw can be driven manually, by a positioning mechanism 204, such as a stepper motor, or by servo motor. Alternative, instead of a single lead screw, an offset cam or an offset wheel can also be used.

FIG. 6 shows an embodiment 600 of the present invention, showing movable wall 102 driven by a servo-motor 601 through a rack-and-pinion mechanism. In this description, like elements in the figures are given like reference numerals. As shown in FIG. 6, collared rack 602, which is attached to movable wall 102 of inductive strip waveguide bandpass filter 100 and enclosed in bushing 603, moves up and down (i.e. direction 108) shaft 605 to vary the "A" dimension of resonator cavity 606. Rack 605 is engaged and driven by pinion spur gear 604, which is in turn driven by servo-motor 601.

Figure 3:
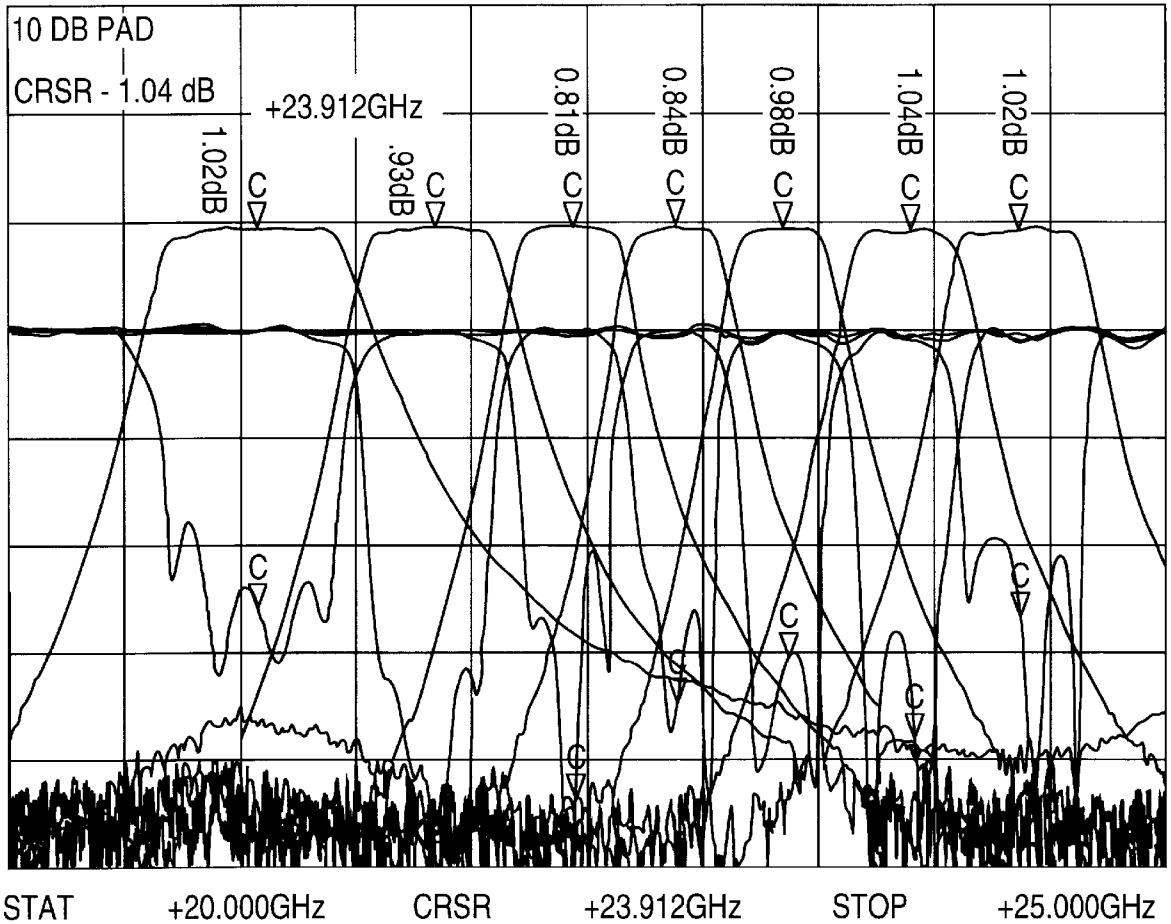
FIG. 3 shows, according to the present invention, as the "A" dimension of the filter varies from 0.35 to 0.465 inches, the frequency responses of a 5-pole inductive strip waveguide bandpass filter moving a center frequency from approximately 20 GHz to 25 GHz.

FIG. 3 shows, as the "A" dimension of the filter varies from 0.35 to 0.465 inches, the frequency responses of a 5-pole inductive strip waveguide bandpass filter, moving a center frequency from approximately 21 GHz to 24 GHz. Note that, in FIG. 3, the scale for insertion loss is 10 dB per division and the scale for return loss is 5 dB per division. In this experiment, for each resonator, using 0.234 inches as the value of the resonator R dimension, the center frequency of filter 100 is varied over 10%, while insertion loss and return loss are maintained at 1.5 dB and 10 dB, respectively, with a bandwidth variation of less than 2 to 1 and a rejection floor at 65 dB. Further, in this embodiment, a center frequency in the 23 GHz range can be set to a precision of 15 MHz. FIG. 5*a* shows Table 1, which tabulates the calculated cut-off wavelengths ($\lambda_c$), the characteristic waveguide wavelengths ($\lambda_g$), and the calculated and measured resonator frequencies ($f_r$), for various A dimension values of filter 100. The calculated resonator frequency is derived using 'Touchstone', a computer program available from the EESOF division, Hewlett-Packard Company. FIG. 5*b* shows the characteristic waveguide wavelengths ($\lambda_g$), and the calculated and measured resonator frequencies ($f_r$), for the same various A dimension values of filter 100 shown in Table 1 of FIG. 5*a.*

The above detailed description is provided to illustrate the specific embodiments of the present invention and is not intended to be limiting. Numerous variations and modifications within the scope of the present invention are possible. The present invention is defined by the following claims.

We claim:

1. A waveguide bandpass filter, comprising:

a conductive waveguide including conductive walls defining a first dimension and a movable conductive wall defining a variable second dimension greater than said first dimension;

means for maintaining ohmic contact between said conductive walls and said movable conductive wall; and an etched septum conductive strip included in said conductive waveguide having a predetermined dimension for defining one or more resonator cavities in said waveguide.

2. A waveguide bandpass filter as in claim 1, wherein said conductive strip comprises an inserted etched septum.

3. A waveguide bandpass filter as in claim 1, further comprising a lead screw for setting said movable conductive wall to predetermined positions relative to said conductive walls, thereby providing predetermined values for said variable second dimension.

4. A waveguide bandpass filter as in claim 3, further comprising a motorized control mechanism for setting said predetermined positions of said movable conductive wall.

5. A waveguide bandpass filter as in claim 4, wherein said motorized control mechanism comprises a stepper motor.

6. A waveguide bandpass filter as in claim 4, wherein said motorized control mechanism comprises a servo-motor.

7. A waveguide bandpass filter as in claim 4, wherein said motorized control mechanism comprises a motor and a rack-and-pinion mechanism coupled to said movable wall, said motor driving said rack-and-pinion mechanism to control the position of said movable wall.

8. A waveguide bandpass filter as in claim 1, further comprising an offset cam for setting said movable conductive wall to predetermined positions relative to said conductive walls, thereby providing predetermined values for said variable second dimension.

9. A waveguide bandpass filter as in claim 1, further comprising an offset wheel for setting said movable conductive wall to predetermined positions relative to said conductive walls, thereby providing predetermined values for said variable second dimension.

10. A waveguide bandpass filter as in claim 1, wherein said movable wall has one or more grooves running along said movable wall and wherein said means for maintaining ohmic contact comprises a conductive elastomer gasket provided in said one or more grooves.

11. A waveguide bandpass filter as in claim 1, wherein said means for maintaining ohmic contact comprises a metallic trough appurtenant to said movable conductive wall and providing a spring action for maintaining the position of said movable conductive wall relative to said conductive walls.

12. A method for providing a waveguide bandpass filter of a predetermined center frequency, comprising the steps of:

including, in a waveguide, conductive walls defining a first dimension and a movable conductive wall defining a variable second dimension greater than said first dimension;

maintaining ohmic contact between said conductive walls and said movable conductive walls;

including an etched septum conductive strip in said conductive waveguide having a predetermined dimension for defining one or more resonator cavities in said waveguide, such that said resonator cavity, when coupled with a possible value of said variable second dimension, has a resonating frequency within a predetermined percentage of said desired center frequency; and adjusting the position of said movable conductive wall such that said predetermined center frequency is attained as resonating frequency.

* * * * *